US008292212B2

(12) United States Patent
Pellengo Gatti

(10) Patent No.: US 8,292,212 B2
(45) Date of Patent: Oct. 23, 2012

(54) METHOD, MANDREL AND DEVICE FOR THE REMOVAL OF CORELESS ROLLS OF A STRETCH FILM

(75) Inventor: Roberto Pellengo Gatti, San Pietro Mosezzo (IT)

(73) Assignee: NO. EL. S.R.L., San Pietro Mosezzo (IT)

( * ) Notice: Subject to any disclaimer, the term of this patent is extended or adjusted under 35 U.S.C. 154(b) by 0 days.

(21) Appl. No.: 13/379,705

(22) PCT Filed: Jun. 4, 2010

(86) PCT No.: PCT/EP2010/057854

§ 371 (c)(1),
(2), (4) Date: Dec. 22, 2011

(87) PCT Pub. No.: WO2010/149479

PCT Pub. Date: Dec. 29, 2010

(65) Prior Publication Data

US 2012/0104140 A1 May 3, 2012

(30) Foreign Application Priority Data

Jun. 25, 2009 (IT) ..... MI2009A1130

(51) Int. Cl.
*B65H 19/22* (2006.01)

(52) U.S. Cl. ..... 242/533; 242/532.2; 242/576.1

(58) Field of Classification Search ..... 242/532.1, 242/532.2, 533, 332.3, 576.1
See application file for complete search history.

(56) References Cited

U.S. PATENT DOCUMENTS 2,567,387 A 9/1951 Link
4,744,287 A 5/1988 Miyamoto
5,337,968 A 8/1994 De Bin et al.
5,613,421 A 3/1997 Abe
6,186,436 B1 * 2/2001 Selle et al. ..... 242/532.2
6,270,034 B1 8/2001 Kury et al.
6,595,458 B1 7/2003 Biagiotti
7,100,864 B2 * 9/2006 Weis ..... 242/615.12

(Continued)

FOREIGN PATENT DOCUMENTS

EP 0 831 047 A1 3/1998

(Continued)

OTHER PUBLICATIONS

International Search Report Dated August 30, 2010 Issued in PCT/EP2010/057854.

(Continued)

*Primary Examiner* — Sang Kim
(74) *Attorney, Agent, or Firm* — Lucas & Mercanti, LLP

(57) ABSTRACT

A method, a mandrel and a device for removing coreless rolls of a plastic film. The mandrel comprises a tubular body having a plurality of radial holes, conformed with a chamber for distributing pressurized air, in which a piston suitable for being magnetically coupled with an external drive member slides. When a roll must be removed, pressurized air is supplied to the fore end of the mandrel, and escapes from all the holes to expand the internal turns of the roll which can be taken off without friction. As the roll advances along the mandrel, the magnetically driven piston progressively reduces the volume of the air chamber preventing at the same time the air to escape from the holes that progressively come to lie on the rear side of the mandrel, with consequent saving of compressed air.

10 Claims, 6 Drawing Sheets

U.S. PATENT DOCUMENTS

| | | | | |
|---|---|---|---|---|
| 7,775,475 | B2 * | 8/2010 | Tanaka et al. | 242/532.2 |
| 7,942,363 | B2 * | 5/2011 | Gelli et al. | 242/532.2 |

FOREIGN PATENT DOCUMENTS

| | | | |
|---|---|---|---|
| EP | 0 995 708 | A2 | 2/2000 |
| EP | 1 813 534 | A1 | 8/2007 |
| WO | 2006/012933 | A1 | 2/2006 |

OTHER PUBLICATIONS

Written Opinion of the International Searching Authority, Dated Jul. 20, 2010 Issued in PCT/EP2010/057854.

* cited by examiner

METHOD, MANDREL AND DEVICE FOR THE REMOVAL OF CORELESS ROLLS OF A STRETCH FILM

This application is a U.S. national stage of PCT/EP2010/057854 filed on Jun. 4, 2010 which claims priority to and the benefit of Italian Application No. MI2009A001130 filed on Jun. 25, 2009, the contents of which are incorporated herein by reference.

BACKGROUND OF THE INVENTION

The present invention relates to the removal of coreless rolls of a stretch film wound up on a perforated mandrel, by means of which a cushion of pressurised air is generated to cause a radial expansion and compaction of the internal turns of the coils, allowing said coils to be slidably removed without frictional forces.

In particular, the invention is directed to a method as well as to a mandrel and a device for removing coreless rolls of a stretch film in winding machines, said method, mandrel and device being suitable for achieving a substantial reduction of the compressed air consumption.

The invention is suitable for winding and removing coreless rolls of stretchable plastic films, normally used for packaging of industrial products, for example for wrapping palletised loads or other similar applications, for which the demands for improving the production process, reducing the costs for winding and removing the rolls, as well as simplifying the management problems, appear to be always more important.

For the present invention, stretch film is a thin continuous web of plastic material, obtained by extrusion or co-extrusion of one or more layers, with thicknesses comprised for example between 10 and 80 microns, or higher.

Stretch films hold a preeminent position in packaging due to their excellent functional qualities; one of the characteristics that are distinguishing a stretch film from any other web material is its "cling", that is the ability of the stretch film to adhere to itself creating a seal on the package.

Mechanical properties of a stretch film are also relevant in relation to the tear and pull resistance, with stretch values up to 100-140% and more, and a relatively low Young's modulus; use of stretch film in packaging have proved to reduce the amount of film consumption as much as 40-50%.

Furthermore use of correctly wound up coreless rolls of stretch-films having a number of compacted internal turns, which maintain a cylindrical shape of the rolls after the removal from the mandrel, that is suitably conformed to avoid any risk of implosion and deformation of their cylindrical shape, is a very relevant characteristic that makes the packaging and wrapping of palletized loads by stretch films, easier and faster, with significantly higher output. Therefore, the use of stretch films, in respect to other web materials and different technical fields, is very important.

Considering these characteristics, in particular the autoadhesive or cling property of the stretch films normally used in the packing field, the method, the mandrel and the device according to the present invention besides enabling the internal turns of the rolls to be compacted, that stabilises the shape and the diameters of said internal turns during the time, aid as well the rolls to be taken off and removed without friction from the winding mandrel, so as to achieve a substantial reduction of the pressurised air consumption and energy saving.

STATE OF THE ART

Various products such as paper, plastic films and similar, are typically obtained in form of a continuous web that is wound up in rolls of middle or large diameter, said rolls being then re-wound for forming rolls of smaller size.

With the conventional re-winding systems, the rolls are wound up on a small rigid tube, of cardboard or plastic material suitable for providing a support to the turns of the roll during winding, as well as for forming rolls of perfectly cylindrical shape. Furthermore, the small rigid tube prevents the roll from imploding, by assuring a constant internal diameter, required for using the rolls in automatic wrapping machines, or with manual winding devices. However, the use of normal, small winding tubes involves some complex process for forming the rolls, as well as high costs for managing and disposal of said tubes.

In order to solve the problems related with the use of the normal tubes for winding up rolls of a plastic film, or other web material, use was already proposed of a tubular mandrel, provided with a longitudinal chamber for the distribution of pressurised air, which is caused to outflow through a plurality of perforations or radial holes. At the end of the winding step of a roll, pressurised air is caused to flow into an air distribution chamber and through holes of the mandrel to generate a cushion of pressurised air capable of slightly expanding the internal turns of the roll to reduce the frictional forces between the contact surfaces; thus, the use of the conventional, winding tubes is totally eliminated.

An apparatus and a perforated mandrel of the type referred to above, are known for example from WO 2006/012933 of the same applicant, for forming coreless rolls of stretch films, in packaging or wrapping of palletized loads; furthermore the use of a perforated mandrel in different application fields, for example for winding up paper rolls or other material is known from EP-A-0831047, EP-A-0995708, U.S. Pat. Nos. 6,270,034 and 6,595,458.

A common problem to the mandrels and the apparatuses of this type, which make use of perforated mandrels of conventional type, consists in the impossibility of preventing the air leakage and a control of the consumption of pressurised air required to provide the air cushion for the radial expansion and for supporting the rolls during the removal from the mandrel.

In the apparatuses of known type, the pressurised air usually is supplied at the rear end of an air chamber of the mandrel; therefore, sliding of the roll along the mandrel during the removal step, progressively uncovers the holes for the outflowing of the air that progressively become uncovered starting from the rear side of the roll; pressurised air escapes from the uncovered holes, which is ineffectively lost into the external environment. Due to the ineluctable leakage of air, the pressure inside the mandrel progressively tends to reduce, producing a smaller thrust for expanding the internal turns, or an undesirable narrowing of the roll hole in the last section of the mandrel, with consequent frictional forces and difficulties for taking off, due to a reduction of the expanding force.

In order to reduce the pressure drop and to maintain an air cushion as more homogeneous as possible between the mandrel and the wound product, EP-A-1813534 suggests the use of a perforated mandrel partitioned by internal walls in more separate air distribution chambers, suitable to be conjointly connected to a pressurised air source by respective coaxial ducts which open at the rear end of each air chamber of the mandrel. The use of separate air distribution chambers, in substitution of the single air chamber, has been proposed in order to maintain a cushion of air as homogeneous as possible during the removal of the rolls; however, such solution does not prevent the leakage of air typical of a conventional mandrel, since each single air chamber is again fed at the rear end thereof, and since the holes of the mandrel continue to be progressively uncovered during the removal of a roll, with consequent loss of air.

OBJECTS OF THE INVENTION

The main object of the present invention is to provide a method for winding up coreless rolls of a stretch film normally used for packaging and wrapping palletized loads, by means of which the generation of an air cushion is made possible, suitable for providing and maintaining an expanding force for the internal turns of the roll, having a substantially constant value during the entire removal stroke of a roll or rolls, simultaneously enabling the consumption of pressurised air to be remarkably reduced, and energy to be saved.

A still further object of the present invention is to provide a mandrel, a device and an apparatus suitable for the above mentioned method, wherein the air loss through the holes of the mandrel during the taking off or removal of the rolls, is substantially eliminated, and the air pressure inside the mandrel is maintained at a substantially constant value.

BRIEF DESCRIPTION OF THE INVENTION

All above can be achieved by a method according to claim 1, wherein a perforated mandrel is used according to claim 2, provided with an internal slidable piston for preventing the air to escape from the holes of the performed mandrel that are progressively uncovered by the rolls during the removal, as well as by means of a device according to claim 7.

In general, the invention consists in providing a tubular mandrel conformed with a single longitudinal air chamber for distribution of pressurized air, having a peripheral wall provided with a plurality of perforations or holes, wherein the pressurised air is supplied at the fore end of the air chamber, and wherein the volume of the air chamber, during the removal of at least one roll, or a plurality of rolls, is progressively reduced, starting from the rear to the fore end thereof, by advancing a piston inside the mandrel to gradually reduce the volume of the air chamber, and in which the piston is magnetically clamped to an external drive member, operatively connected, or suitable to be connected, to a roll pushing device.

BRIEF DESCRIPTION OF DRAWINGS

These and further features of the method, the mandrel and the device according to the invention, will better appear from the following description of some preferred embodiments, with reference to the drawings, in which.

DETAILED DESCRIPTION OF THE INVENTION

With reference to the FIGS. 1 to 5, the general features and a first preferred embodiment of the mandrel and the device for winding up and remove of coreless rolls of a stretch film, according to the present invention, will be described.

Figure 1:
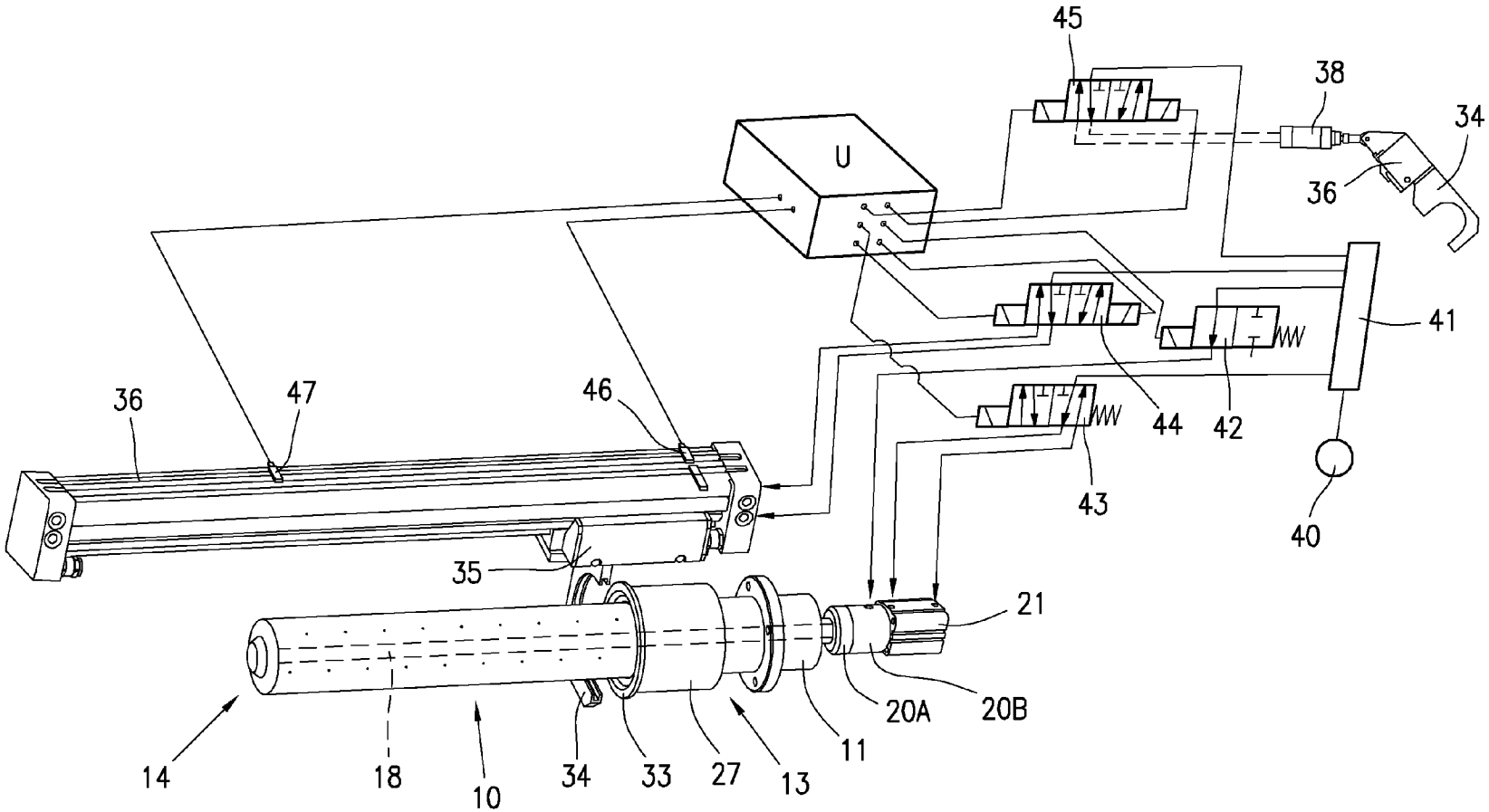
FIG. 1 shows a perspective view of the device, according to a first embodiment of the invention, in a first working condition.
Figure 2:
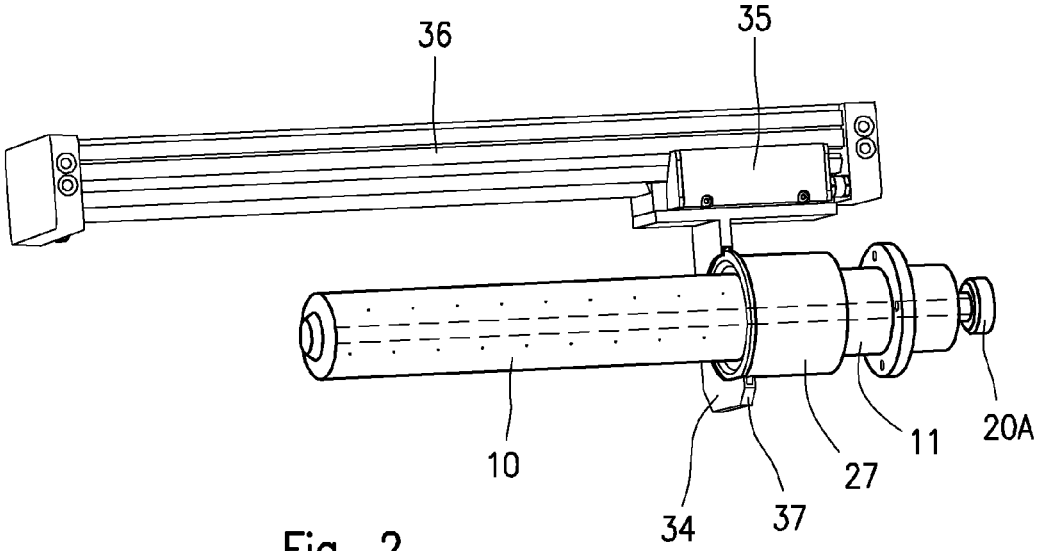
FIG. 2 is a perspective view similar to FIG. 1, in a second working condition, wherein the air supplying circuit was omitted.

As shown in FIG. 1, the device comprises, a mandrel 10 supported by a sleeve 11, for freely rotation about a horizontal axis, the sleeve 11 being fastened to a frame, not shown, of a machine for winding up the rolls.

Figure 4:
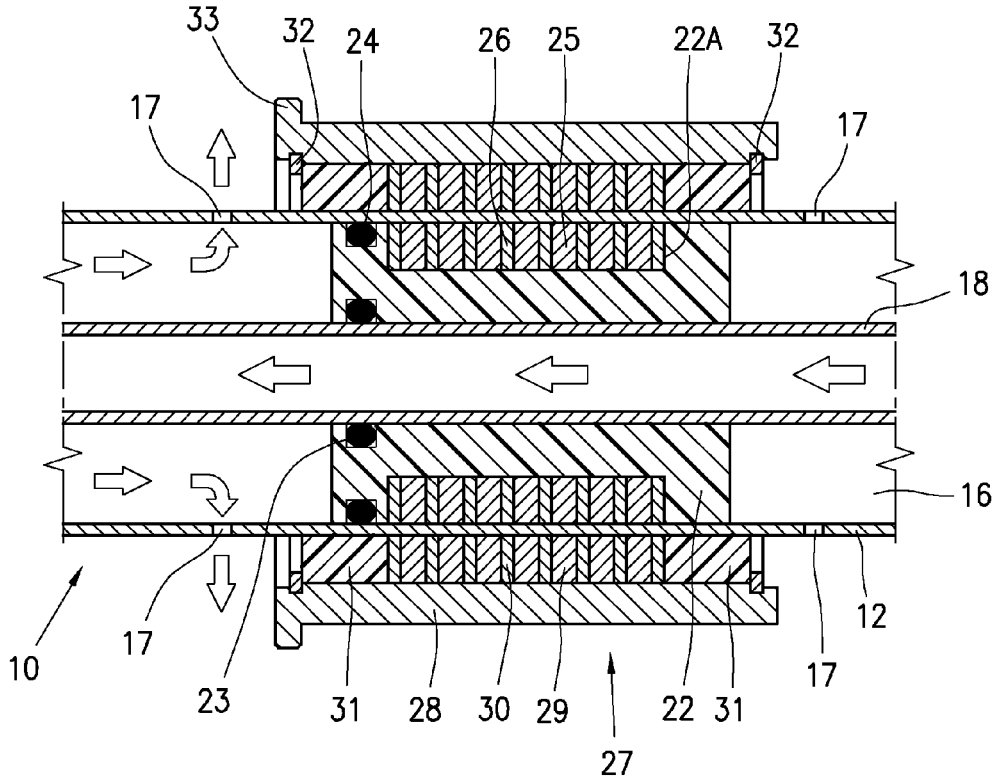
FIG. 4 is an enlarged detail, in longitudinal cross sectional view, of the mandrel and the magnetic clamping system between the piston internal to the mandrel and the external drive member.
Figure 5:
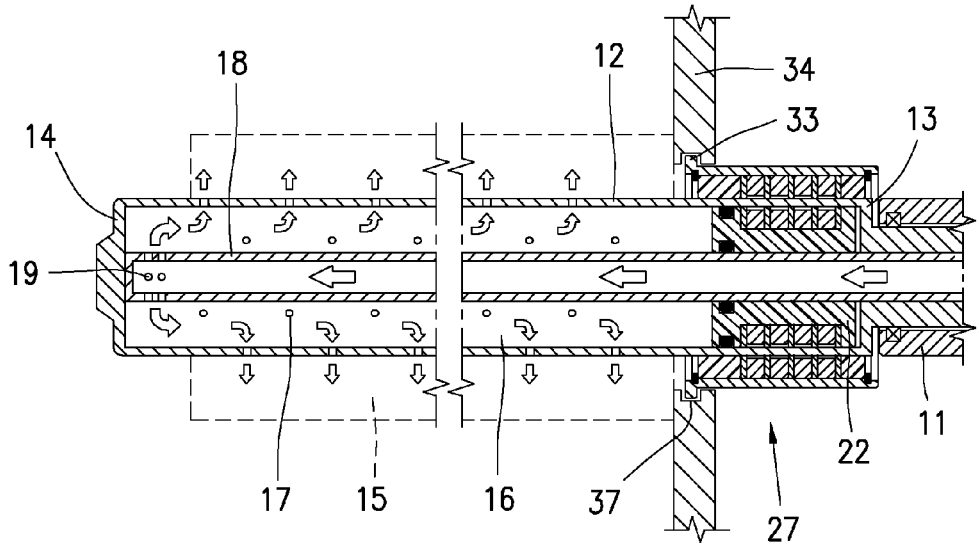
FIGS. 5, 6 and 7 are three longitudinal cross sectional views suitable for diagrammatically showing three different working conditions of the piston and air flow internal to the mandrel, during the removal of a roll.

As shown in FIGS. 4 and 5, the mandrel 10 comprises a tubular body having a cylindrical wall 12, which longitudinally extends along the rotation axis of the mandrel, between a rear end 13, FIG. 5, near the supporting sleeve 11, and a fore end 14 for removal or taking off a coreless roll, schematically indicated by reference 15.

The tubular body of the mandrel 10 is closed at both ends and defines an air chamber 16 for distribution of pressurised air, the pressurised air outflowing through perforations comprising a plurality of radial through holes 17, distributed on the peripheral wall 12 of the mandrel 10.

For the reasons explained below, the body of the mandrel 10 consists of a tubular element in aluminium or other metallic magnetically non conductive material, and is conformed with an external surface, properly treated for providing a low friction force, facilitating the flow of the pressurised cushioning air and the sliding of the rolls 15 during removal.

According to a characteristic of the present invention, unlike the conventional previously known mandrels, the pressurised air is supplied at the fore end of the chamber 16, i.e. at the fore end 14 of the mandrel 10; that can be achieved, for example, by means of an air feeding tube 18 protruding into the air chamber 16 from the rear end 13, of the mandrel coaxially arranged to the peripheral wall 12 of the mandrel, said air feeding tube 18 extending close to the fore end 14, at which end the tube 18 is provided with a crown of holes 19 for the exit of air.

Since the mandrel 10 must be free to idly rotate during winding up of the coreless rolls 15, the air feeding tube 18 must be connected to a source of pressurised air in a manner suitable for being disconnected. Thus, as shown in FIG. 1, the tube 18 terminates, at the rear end with a first pneumatic coupling device 20A, which can be engaged by a second pneumatic coupling device 20B attached to the rod of a pneumatic cylinder or other linear actuator 21.

Internally to the mandrel 10, coaxially with the air chamber 16 and the air feeding tube 18 for supplying the pressurised air, FIGS. 4 and 5, a movable piston member 22 is sealingly arranged, which can be magnetically clamped and driven, as described below, for being moved in a controlled manner between the rear end and the fore end of the air chamber 16, so as to progressively reduce the volume of the fore portion of the same air chamber 16, into which pressurised air is supplied, preventing at the same time the pressurised air to flow backwards.

In this regard, the piston 22 comprises a cylindrical body of magnetically non-conductive material, for example polythene or other plastic low frictional material and is conformed with an axial hole through which the tube 18 extends for supplying the pressurised air; the axial hole of the piston 22 exhibits an internal diameter substantially corresponding to or larger than the external diameter of the tube 18, while a pressurised air-tight seal is allowed by one or more O-ring 23 in corresponding seats at the fore end of the piston 22.

Similarly, the piston 22 exhibits an external diameter substantially corresponding to the internal diameter of the peripheral wall 12 defining the air chamber 16 of the mandrel, while a seal is enabled once again by one or more O-ring 24 in one or more seats still arranged at the fore end of the piston 22; thus, the pressurised air, present in the fore portion of the air chamber 16, is prevented from flowing towards the rear end of the piston 22, back in the rear portion of the air chamber 16 to outflow from the holes 17 and to be vented towards the external environment, while the piston 22 is magnetically drown forwards during the removal of a roll 15.

Driving of the piston 22 along the air chamber 16 of the mandrel 10 can be carried out by providing a magnetic coupling device between said piston 22 and an external drive member 27, as explained below. In this regard, it is specified that a magnetic system for driving a piston was already suggested in rodless pneumatic cylinders, as disclosed in U.S. Pat. Nos. 4,744,287 and 5,613,421, for quite different purposes in respect to the magnetic coupling system in mandrels for winding up coreless rolls according to the present invention.

Whilst in a rodless cylinder the piston carries out an active function of driving an external carriage to which the piston is magnetically clamped to move a load, in an apparatus according to the present invention the piston 22 provides a double function of progressively reducing the volume of the fore portion of the air chamber 16, wherein pressurised air is supplied, as well as to prevent a backwards flow of air towards the rear portion of the chamber 16, avoiding any leakage of air; furthermore, the operative connection between the piston 22, the drive member 27 and a pushing device 34 for removing the rolls 15, must be conformed in a mode suitable for being disengaged, i.e. in such a mode to enable the mandrel 10 to freely rotate during the winding up of the rolls, and to be magnetically engaged during the removal of the coreless rolls 15 at the end of winding.

According to this first embodiment, shown in the FIGS. 1 to 4, the piston 22 comprises a cylindrical body of plastic material, provided with an annular seat 22A, wherein a first plurality of permanent magnets 25 of annular shape are arranged and axially spaced apart by a plurality of magnetic yokes or spacers 26.

The device further comprises an external drive member 27 magnetically clamped to the internal piston 22.

More precisely, in the example under consideration, the drive member 27 comprises a cylindrical sleeve 28 of aluminium or other magnetically non-conductive material, coaxially sliding with respect to the mandrel 10; inside the sleeve 28, a second plurality of permanent magnets 29 of annular shape and magnetic yokes or spacers 30 are arranged, facing corresponding magnets 25 and magnetic yokes or spacers 26 of the piston 22; two slides 31 of polythene or other plastic material, suitable for enabling a sliding substantially free of frictional forces, are retained inside the sleeve 28 by two snap rings 32, at both ends.

The permanent magnets 25 of the piston 22 may exhibit poles of a same or of opposite polarities N and S, said poles of the magnets 25 facing poles of opposite polarity of the external drive member 27; in this manner, a plurality of linked magnetic circuits are provided capable to generate a drive force on the piston 22 higher than the force applied on the same piston 22 by the air pressure existing in the fore portion of the air chamber 16, which force would oppose advancing of the piston 22.

In the example under consideration, the magnetic clamping system between piston 22 and drive member 27 must also be conformed so that the drive member 27 can be engaged in turn by a roll pushing device 34 for moving and ejecting the rolls 15, when the piston 22 must be driven along the mandrel 10; or said drive member 27 can be disengaged during winding up of the rolls 15, for enabling a free rotation of the mandrel 10, magnetically clamped to the drive member 27.

Figure 3:
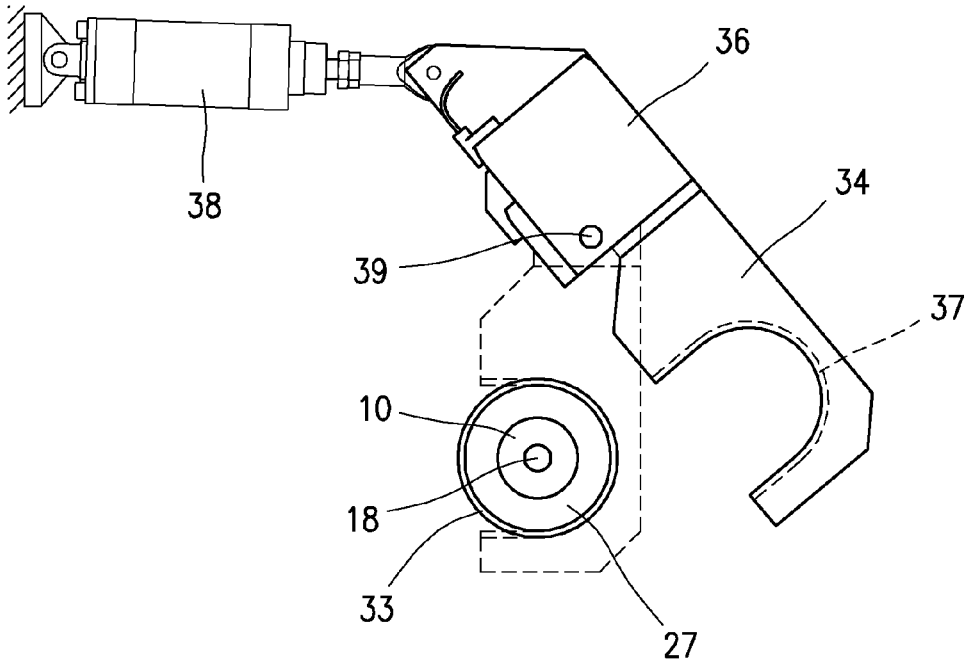
FIG. 3 is a detail of FIG. 1, suitable for showing the system for connecting the roll pushing device to the drive member for magnetically clamping movable piston inside the air chamber of the mandrel.

In the case of FIGS. 1 to 4, the sleeve 28 exhibits, at its fore end, a radial flange 33 that, in the fully withdrawn position of the drive member 27, FIGS. 1 and 3, can be engaged and disengaged by the pushing device 34 for the rolls 15; the pushing device 34 in turn is connected to a carriage 35, sliding along a rodless cylinder 36 or linear actuator, that extends on one side of the mandrel 10.

The roll pushing device 34 for removing the rolls 15, in the shown case, consists of a C-shaped element, having an annular groove 37 along an internal edge, said annular groove 37 being suitable for engaging the radial flange 33 of the sleeve 28, as a consequence of an angular movement of the rodless cylinder 36 around a rotational axis; in this regard, as shown in FIG. 3, an end of the rodless cylinder 36 is operatively connected to a second pneumatic cylinder 38, or linear actuator, and pivoted to rotate around an axis 39 between a first angular position, wherein the pushing device 34 is disengaged from the flange 33 of the sleeve 28, and a second angular position wherein the pushing device 34 is engaged with the flange 33, as shown in FIG. 3.

Returning to FIG. 1, the pneumatic circuit is shown for connecting the mandrel 10 and control cylinders to a source 40 of pressurised air, via a manifold 41.

More precisely, the tube 18 that supplies pressurised air to the fore end of the air chamber 16 of the mandrel 10, is suitable for being connected to the manifold 41 by the pneumatic coupling device 20A, 20B and a solenoid valve 42 of mono-stable type; the double-acting cylinders 21, 36 and 38 are suitable for being connected, in turn, with the header 41 by respective solenoid valves 43, 44 and 45 of bi-stable type. The various control solenoid valves are selectively actuable by an electronic control unit U, of programmable type, that receives position signals of the carriage 35, said position signals being provided by two limiting sensors 46, 47, adjustable in position along the cylinder 36.

Figure 6:
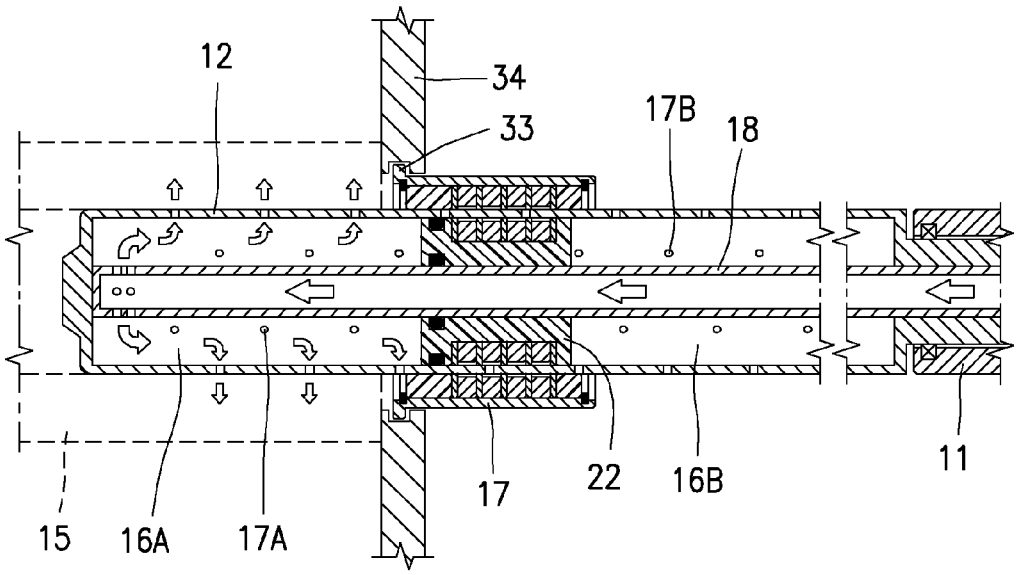
Figure 7:
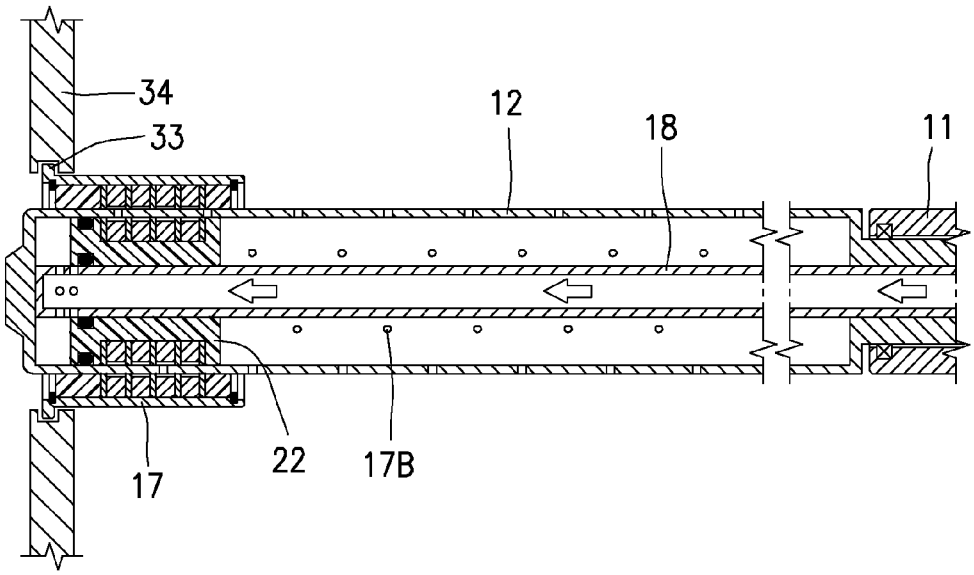

With reference now to FIGS. 5, 6 and 7, the basic steps of the method will be described, together with the main characteristics of the mandrel and the device according to the invention.

As known, in a machine for winding up coreless rolls of a stretch film, whether of single mandrel type or of multimandrel type, for example of the type disclosed in U.S. Pat. No. 5,337,968, during the winding step of a roll 15 the mandrel 10 freely rotates at a high rotational speed under the action of a drive roller, not shown, which is urged against the roll 15, or the rolls 15 that can be simultaneously wound up on a same mandrel 10.

In this condition, shown in FIG. 5, the piston 22 and the magnetic drive member 27 are both positioned at the rear end 13 of the mandrel, while the cylinder 36 results angularly rotated in the rear position of FIG. 1, wherein the pushing device 34 is disengaged from the magnetic drive member 27 of the piston 22.

Once one or a plurality of rolls have been wound on the same mandrel 10, the rotation of the mandrel 10 is stopped and the stretch film is cut, freeing the roll 15 which, thus, can be now removed.

At the start of the removal step for ejecting a roll 15, the piston 22 and the drive member 27 are still in the rear position at the rear end 13 of the mandrel 10, as shown in FIG. 5.

A this point, on the basis of an operative program stored in the control unit U, the solenoid valve 45 is actuated to supply pressurised air to the cylinder 38, causing the cylinder 36 to angularly rotate forwards; in this manner, the pushing device 34 engages the flange 33 of the drive member 27 for magnetically driving the piston 22.

After the pushing device 34 has been engaged by the magnetic drive member 27, the control unit U actuates the solenoid valve 43 for supplying pressurised air to the cylinder 21, to advance the second pneumatic coupling device 20B against the first pneumatic coupling device 20A.

Once the two pneumatic coupling devices 20A and 20B have been connected, the electronic control unit U, always on the basis of the stored operative program, actuates, in rapid sequence, both the solenoid valve 42 and the solenoid valve 44.

As soon as the solenoid valve 42 is actuated, pressurised air is supplied to the fore end of the chamber 16 of the mandrel 10 by the tube 18; in this condition, shown in FIG. 5, the pressurised air flows backwards into the air chamber 16 in an attempt to outflow from all the holes 17 of the mandrel, which are covered at this time by the roll 15. Thus, between the opposite surfaces of the mandrel 10 and internal turns of the roll 15 of stretch film, a cushion of pressurised air is generated, which radially expands the internal turns of the roll 15, by slightly detaching them from the surface of the mandrel, up to give rise to a narrow annular gap causing a compaction of a number of internal turns due to the cling of the stretch film. The pressurised air is continuously supplied into the air chamber 16 of the mandrel and flows along this narrow annular gap, exiting to the external environment from the two ends of the roll.

After having supplied pressurised air into the chamber 16 of the mandrel, the control unit U actuates the solenoid valve 44 by connecting one side of the cylinder 36 with the pressurised air source 40; the cylinder 36 moves forward the carriage 35 and the pushing device 34, advancing the roll 15 along the mandrel 10; simultaneously the piston 22, magnetically clamped to the drive member 27, previously connected to the pushing device 34, is moved forwards into the air chamber 16.

As the roll 15 and the piston 22 are advanced, the holes 17A in the fore portion 16A of the air chamber 16 continue to be covered by the roll 15, preventing the outflow of the air, while the holes 17B, which come to lie in the rear portion 16B of the chamber 16, behind the piston 22, progressively are uncover.

Since the holes 17A continue to be covered by the roll 15, the only consumption of air merely consists of the small amount of air flowing along the annular gap between the mandrel 10 and the turns forming the internal hole of the roll 15; conversely, since the piston 22 prevents any fluid communication between the fore portion 16A and the rear portion 16B of the air chamber 16 of the mandrel 10, no air leakage can exist from the holes 17B, as said holes 17*b* come to lie upstream of the piston 22, at the rear portion 16B of the chamber 16. Instead, pressurised air will continue to be supplied into the fore portion 16A of the air chamber of the mandrel; this condition is shown in FIG. 6.

As the roll 15 and piston 22 continue to be moved forwards, the volume of the fore portion 16A of the air chamber 16, into which pressurised air is supplied, will be progressively reduced, whilst the piston 22 will continue to tightly seal towards the rear portion 16B, preventing any air leakage through the large number of holes 17B that progressively are uncovered.

Once the ejection of the roll 15 has taken place, the piston 22 comes to lie at the fore end of the chamber 16, in the condition that any air leakage from all the holes 17 of the mandrel 10 is totally prevented; this condition is shown in FIG. 7.

A this point, the supply of pressurised air into the chamber 16 is stopped by opening the pneumatic coupling devices 20A and 20B; then the supply of air into the cylinder 36 is reversed, bringing again the pushing device 34, the magnetic drive member 27 and the piston 22 back to the completely rear position of FIG. 5. Once the piston 22 has reached this position, the cylinder 36 is actuated to rotate backwards, disengaging the pushing device 34 from the magnetic drive member 27.

The mandrel 10 results now totally free to rotate, ready for winding up a new roll 15, which successively can be removed in the manner previously disclosed.

Figure 8:
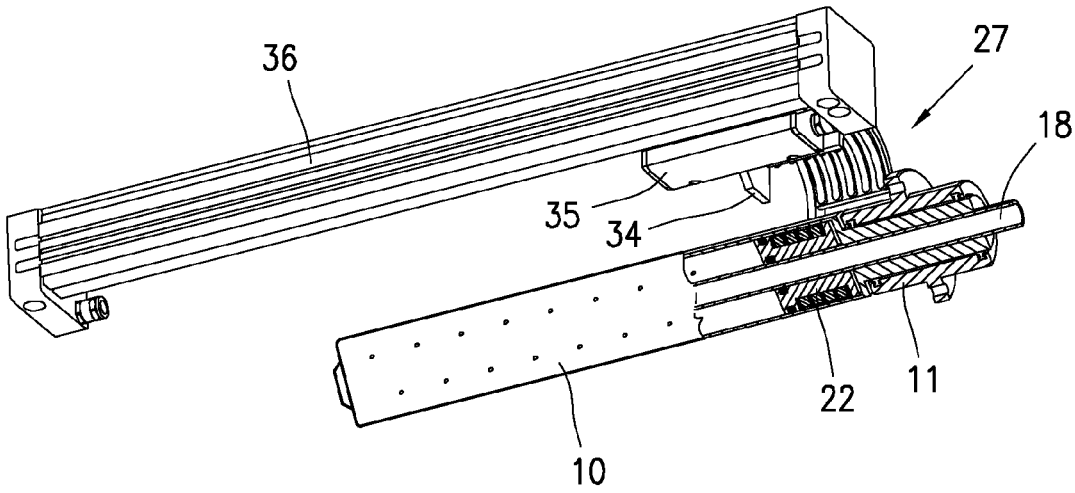
FIG. 8 is a perspective view of a second embodiment of the device according to the invention, in a first working condition.
Figure 9:
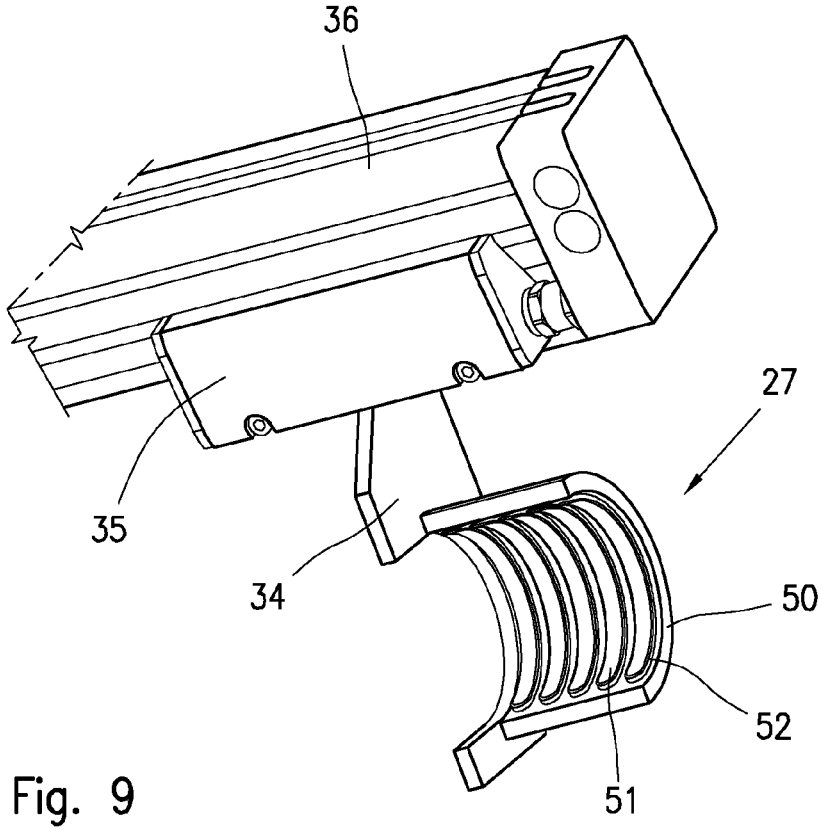
FIG. 9 is an enlarged detail of FIG. 8.
Figure 10:
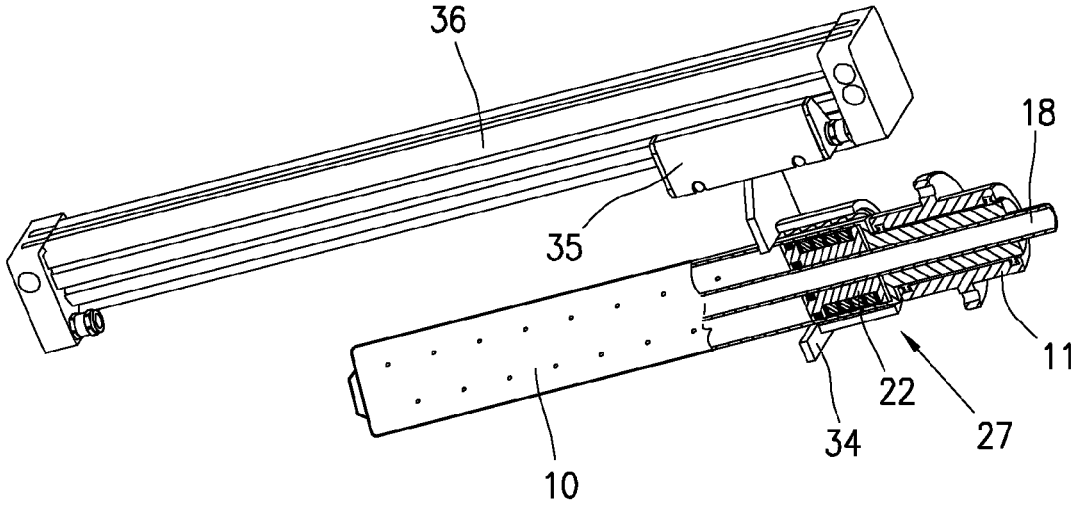
FIG. 10 is a view similar to FIG. 8, in a second working condition.

FIGS. 8 to 10 show a second embodiment of the apparatus according to the present invention. The solution of FIGS. 8 to 10 differs from the preceding solution in respect to some characteristics of the magnetic drive member 27 for the piston 22. For all remaining, the solution of FIGS. 8-10 and the working mode do not substantially differ from the solution and the working mode of FIGS. 1 to 7; therefore, also in FIGS. 8-10 the same reference numbers have been used as FIGS. 1-7 to indicate similar or equivalent parts.

According to the preceding example of FIGS. 1-7, the operative connection between the piston 22 and the pushing device 34 occurs by means of a magnetic drive member 27, constantly clamped to the piston 22, wherein the drive member 27 can be engaged and disengaged from the pushing device 34 by an angular rotation of the control cylinder 36.

FIGS. 8 to 10 show a second, more structurally simple solution, which differs from the preceding solution in the different conformation of the magnetic system for clamping the piston 22 to the drive member 27 for pushing and ejecting rolls 15 from the mandrel 10.

As shown in FIG. 8, the mandrel 10 and the piston 22 are conformed in a quite identical manner to the mandrel and the piston of the preceding example; conversely, in the case of FIG. 8, as better shown in the enlarged detail of FIG. 9, the magnetic drive member 27 for the piston 22 is directly fastened to the pushing device 34 and consists of a hemi-cylindrical, or C-shaped element, having an internal curvature radius substantially corresponding to or slightly greater than the external curvature radius of the mandrel 10. Thus, by the angular rotation of the control cylinder 36, for the pushing device 34, the magnetic drive member 27 of the piston 22 can be moved between a backwards position, shown in FIG. 8, wherein the drive member 27 is angularly spaced apart from the mandrel 10 and magnetically disengaged from the piston 21, and a forwards or advanced position, shown in FIG. 10, wherein the magnetic drive member 27 partially encircle the mandrel 10, and is magnetically clamped to the piston 22.

The drive member 27, in the case of FIG. 9, consists of a half-ring 50, protruding on the rear side, coaxially arranged to the C-shaped pushing device 34; the half-ring 50, on the internal side, facing the mandrel 10, exhibits a plurality of pole expansions 51, of half-circular shape and of magnetically conductive soft iron, around which electrical coils 52 are wound; the coils 52 are suitable for being connected to an electrical power source for generating a magnetic field linking with the magnetic field of the permanent magnets of the piston 22, inside the mandrel 10. Also in this case, the electrical coils 52 of the drive member 27 are suitable for being connected to an electrical power source by a switch device, not shown, that can be activated and deactivated by the control unit U of the device, or of the rolls winding machine.

In alternative to the electromagnetic system disclosed above, the drive member 27 of FIG. 9 can be provided with a plurality of permanent magnets and polar expansions or intermediate spacers of half-circular shape, in a manner quite equivalent to the drive member 27 of FIG. 1.

Figure 11:
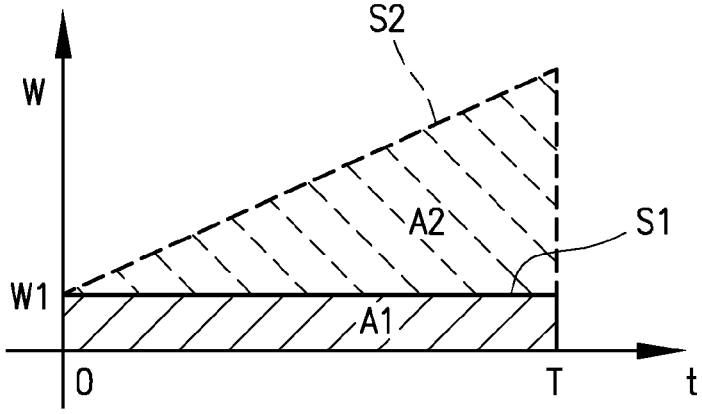
FIG. 11 is a comparative graph for the consumption of air between a mandrel according to the invention, and a conventional one.

FIG. 11 shows a comparative graph between the consumption of compressed air W in a perforated mandrel of conventional type, and the consumption of compressed air in the perforated mandrel forming part of an apparatus according to the present invention.

In particular, in FIG. 11, the progressive consumption of air in a conventional mandrel, during a cycle time T needed for ejecting a roll or a group of rolls wound up on a same mandrel, is indicated by the broken line S2; conversely, the constant consumption of air W1, during the same cycle time T, in a mandrel according to the present invention, is indicated by the continuous line S1.

From the comparison of FIG. 11, it appears that in a mandrel according to the invention, during the time T a consumption of air W1 occurs equal to the area A1, due to only the pressurised air flowing between the mandrel 10 and the internal turns of the roll 15, needed for generating the support air cushioning and radial expansion of the internal turns of the roll; this consumption of air W1 results constant, since, as previously reported, during the forward movement of the piston 22 any air leakage through the holes 17 that are progressively uncovered during the ejection of the roll 15, is fully prevented. Conversely, the area A2 of FIG. 11 shows the greater consumption of air in a conventional mandrel due to the unavoidable leakage through the holes of the mandrel that are progressively uncovered by the forward movement of the roll.

From some experiments carried out with the two types of mandrels, it was noticed that the consumption of air in a mandrel according to the invention is substantially equal to 10% of the total consumption of air of a conventional mandrel, flow rate and pressure being otherwise equal.

Taking into account that the consumption of air WC in a conventional mandrel is given by the following formula:

$$WC=Q/2\times T\times 1{,}1K$$

where:

Q=overall area of the holes of the mandrel;

T=time for ejecting the roll;

K=specific volume of air per second and per unit of longitudinal section of the mandrel.

Furthermore, supposing that:

P=8 bar

Q=55 mm2

T=4 sec

K=1,6 NI/sec mm2 at the pressure of 8 bar.

On the basis of the preceding formula, in a conventional mandrel a consumption of air occurs equal to 190 NI, every ejection cycle of the rolls; conversely, in a mandrel according to the present invention, a consumption of air occurs reduced to 10%, i.e. equal to 19 NI.

All above considered, it results then clear that the use of a mandrel and a device or apparatus according to the present invention, during a full working year, turns out in a substantial energy saving.

All said and shown in the enclosed drawings, was given by way of example of the general features of the invention, in the case of an apparatus with a single mandrel; however, it is clear that the method and the apparatus disclosed are suitable for being applied to any machine for winding up coreless rolls of a stretchable plastic film, wherein two or a plurality of mandrels are supported, by a structure rotating about a horizontal axis, in order to be moved step-by-step between a plurality of working stations, in particular between a station for winding up the rolls, and a station for ejecting the rolls, at which station the magnetic coupling occurs between the piston, inside the mandrel, and the magnetic drive member operatively connected with the pushing device of the rolls.

Therefore, other modifications and/or variations can be made to the entire apparatus and/or to portions thereof, for example regarding the magnetic and/or electromagnetic coupling system between the piston and the drive member, as well as to the means for connecting, in a manner suitable for being disengaged, the pushing device for the rolls with the drive member, or still again to the means for magnetically clamping, in a manner suitable for being disengaged, said drive member to the piston, without thereby departing from the enclosed claims.

The invention claimed is:

1. A method for removing a coreless coil of a plastic film from a winding mandrel having an external surface, said mandrel comprising:

an air distribution chamber axially extending between a back end and a fore end of the mandrel; wherein said air distribution chamber is connectable to a source of pressurized air and is provided with a plurality of air outlet holes to create an air cushion between the external surface of the mandrel and internal turns of the coreless coil; and wherein the coreless coil is removable by sliding it towards the fore end of the mandrel, said method comprising the steps of:

sliding a tight piston inside the air distribution chamber of the mandrel;

feeding pressurized air at the fore end of the air distribution chamber at the moment of removal of the coreless coil; and advancing the coreless coil pushing it along the mandrel and simultaneously magnetically dragging the tight piston along the air distribution chamber, allowing the outflow of the pressurized air from the holes of the mandrel at a front part of the air distribution chamber between the tight piston and the fore end of the mandrel.

2. The method according to claim 1, in which said plastic film is a stretch film.

3. A mandrel for winding up and removing the coreless coil of a plastic film according to claim 1, the mandrel comprising:

a tubular body of magnetically non conductive material, having a peripheral wall defining the air distribution chamber axially extending to the mandrel, between the back end and the fore end and connectable to the source of pressurized air, said peripheral wall being provided with the plurality of air outlet holes, the tight piston sliding inside the air distribution chamber between the back end and the fore end of the mandrel;

an air feeding duct tightly extending into the air chamber through an axial hole of the piston from the back end to the fore end of the mandrel to supply the pressurized air at the fore end of the air distribution chamber; and a piston dragging member movably supported along the mandrel, said piston dragging member being conformed for magnetically engaging and dragging the tight piston along the air distribution chamber of the mandrel.

4. The mandrel according to claim 3, wherein the piston dragging member comprises a first set of permanent magnets inside a dragging sleeve coaxially arranged and sliding on the mandrel, and a second set of permanent magnets on the tight piston, magnetically linked to the first set of permanent magnets inside the dragging sleeve.

5. The mandrel according to claim 4, wherein said first and second set of permanent magnets comprise a plurality of annular magnets and magnetically conductive spacer members side by side arranged on the tight piston, and inside the dragging sleeve.

6. The mandrel according to claim 3, wherein the piston dragging member comprises a hemi-cylindrical sleeve parallely extending to the mandrel, said hemi-cylindrical sleeve comprising a set of semicircular permanent magnets, or electromagnets, to be magnetically linked with the set of permanent magnets of the tight piston;

a linear actuator to move the piston dragging member along the mandrel, said linear actuator being supported to angularly move ston dragging member between a magnetically disengaged position and a magnetically engaged position with the tight piston.

7. A device for removing the coreless coil of a plastic film from the mandrel according to claim 3, comprising a drive including a hooking member disengageably connectable to the piston dragging member, and a linear actuator parallely extending to the mandrel.

8. An apparatus for winding up and removing at least one coreless coil of a plastic film by the device according to claim 7, comprising:

at least one mandrel supported to freely rotate around a longitudinal axis;

valve means for connecting the air feeding duct of the at least one mandrel and a pressurized actuator for the piston dragging member to a pressurized air source; and an electronic control unit, operatively connected to said valve means, said electronic control unit being programmed to selectively connect the air feeding duct of the at least one mandrel, and the pressurized actuator for the piston dragging member, to the pressurized air source by said valve means.

9. The device according to claim 7, comprising a coil pushing member operatively connected to said drive.

10. The device according to claim 7, wherein the hooking member is connected to a carriage of a rodless actuator, and wherein said rodless actuator is supported to engage and disengage by rotation the hooking member and the piston dragging member.

* * * * *